US005350654A

United States Patent [19]

Pai et al.

[11] Patent Number: 5,350,654

[45] Date of Patent: Sep. 27, 1994

[54] PHOTOCONDUCTORS EMPLOYING SENSITIZED EXTRINSIC PHOTOGENERATING PIGMENTS

[75] Inventors: Damodar M. Pai, Fairport; Andrew R. Melnyk; Donald J. Teney, both of Rochester, N.Y.

[73] Assignee: Xerox Corporation, Stamford, Conn.

[21] Appl. No.: 927,984

[22] Filed: Aug. 11, 1992

[51] Int. Cl.[5] ..... G03G 5/09

[52] U.S. Cl. ..... 430/59; 430/78; 430/83; 430/61

[58] Field of Search ..... 430/59, 58, 61, 26, 430/83, 78

[56] References Cited

U.S. PATENT DOCUMENTS

| | | | |
|---|---|---|---|
| 3,121,006 | 2/1964 | Middleton et al. | 96/1 |
| 3,871,882 | 3/1975 | Wiedemann | 96/1.5 |
| 3,904,407 | 9/1975 | Regensburger et al. | 96/1.5 |
| 4,082,551 | 4/1978 | Steklenski et al. | 96/1 PC |
| 4,173,473 | 11/1979 | Petropoulos et al. | 430/72 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,415,639 | 11/1983 | Horgan | 430/57 |
| 4,419,427 | 12/1983 | Graser et al. | 430/58 |
| 4,578,333 | 3/1986 | Staudenmayer et al. | 430/59 |
| 4,578,334 | 3/1986 | Borsenberger et al. | 430/59 |
| 4,587,189 | 5/1986 | Hor et al. | 430/59 |
| 4,588,667 | 5/1986 | Jones et al. | 430/73 |
| 4,618,551 | 10/1986 | Stolka et al. | 430/58 |
| 4,806,443 | 2/1989 | Yanus et al. | 430/56 |
| 4,806,444 | 2/1989 | Yanus et al. | 430/56 |
| 4,818,650 | 4/1989 | Limburg et al. | 430/58 |
| 4,877,702 | 10/1989 | Miyamoto et al. | 430/72 |
| 4,933,244 | 6/1990 | Teuscher et al. | 430/58 |
| 4,935,487 | 6/1990 | Yanus et al. | 528/203 |
| 4,965,440 | 9/1990 | Limburg et al. | 528/99 |
| 5,019,473 | 5/1991 | Nguyen et al. | 430/58 |
| 5,069,991 | 12/1991 | Leyrer et al. | 430/49 |

FOREIGN PATENT DOCUMENTS

| | | |
|---|---|---|
| 0289348 | 11/1988 | European Pat. Off. . |
| 0295115 | 12/1988 | European Pat. Off. . |
| 0295125 | 12/1988 | European Pat. Off. . |
| 0295126 | 12/1988 | European Pat. Off. . |
| 60-70453 | 4/1985 | Japan . |
| 60-218658 | 11/1985 | Japan . |

OTHER PUBLICATIONS

Patent Abstracts of Japan, vol. 9, No. 210 (P-383)(1933) Aug. 28, 1985.

Patent Abstracts of Japan, vol. 10, No. 84 (P-442)(2141) Apr. 3, 1986.

*Primary Examiner*—Marion E. McCamish
*Assistant Examiner*—Rosemary Ashton
*Attorney, Agent, or Firm*—Oliff & Berridge

[57] ABSTRACT

A layered photoreceptor is composed of a substrate, an extrinsic pigment layer that has been sensitized disposed over the substrate, and a charge transport polymer in contact with the pigment layer. A method for producing a photoreceptor comprises depositing a layer of sensitizing electron donor material in a polymer binder on a substrate. An extrinsic pigment layer is deposited on the layer of sensitizing electron donor material. A charge transport layer is deposited on the pigment layer.

20 Claims, 2 Drawing Sheets

PHOTOCONDUCTORS EMPLOYING SENSITIZED EXTRINSIC PHOTOGENERATING PIGMENTS

FIELD OF THE INVENTION

This invention relates to electrophotographic recording elements in general and more particularly to layered photoreceptor elements containing extrinsic photogenerating pigments as charge generating layers. Such layered photoreceptors can be incorporated into numerous imaging devices, including xerographic imaging systems, wherein there are formed on these photoreceptors, for example, electrostatic latent images which can subsequently be developed and transferred to a suitable substrate.

BACKGROUND OF THE INVENTION

Tile formation and development of electrostatic latent images on surfaces of photoconductive imaging members, commonly referred to in the art as photoreceptors, is well known. In these systems, and in particular in xerography, the xerographic plate (or drum or belt) containing a photoconductive insulating member is imaged by uniformly electrostatically charging its surface, followed by exposure to a pattern of activating electromagnetic radiation, such as light, which selectively dissipates the charge in illuminated areas of the photoconductive layer causing a latent electrostatic image to be formed. The latent electrostatic image can then be developed with developer compositions containing, for example, toner particles, optionally combined with carrier liquid or particles. This is followed by transferring the image to a suitable substrate such as paper. This process requires the photoconductive member to photogenerate and transport charge, thereby neutralizing the charge on the surface.

Examples of photoconductive members include members comprised of inorganic materials and organic materials, layered devices of inorganic or organic materials, composite layered devices containing photoconductive substances dispersed in other materials, and the like. Current layered organic photoreceptors have a substrate layer and two active layers: (1) a thin charge generating layer containing a light-absorbing pigment, and (2) a thicker charge transport layer containing electron donor molecules in a polymer binder. The electron donor molecules (e.g., triaryl diamines) provide hole or charge transport properties, while the electrically inactive polymer binder provides mechanical properties. The charge transport layer can alternatively be made from a charge transporting polymer such as poly(N-vinylcarbazole), polysilylene or polyether carbonate, wherein the charge transport properties are incorporated in the mechanically strong polymer. These photoconductive members can optimally include a charge blocking and/or adhesive layer between the charge generating and the conductive layers. Additionally, they may contain protective overcoatings and the substrate may comprise a nonconductive and a conductive layer. Additional layers to provide special functions such as incoherent reflection of laser light, dot patterns for pictorial imaging or subbing layers to provide chemical sealing and/or a smooth coating surface may also be employed.

In a preferred photoreceptor, the photoreceptor surface is charged to a negative polarity by a corona device and discharged by visible or infrared light or radiation to form a charge pattern or image. The light is primarily absorbed by the pigment in the charge generating layer which photogenerates the charge carriers. The positive charges in this pigment or charge generating layer are injected into the charge transport layer and transported to the surface of the charge transport layer, thereby discharging the layers.

Generally, pigments used in the charge generating layer can be classified into two classes on the basis of their photogeneration mechanisms: (1) intrinsic and (2) extrinsic. In intrinsic pigments, the positive and negative charges are separated directly and transported internally, without the assistance of a charge transporting species, to the surface of the charge generating layer. Selenium, selenium tellurium alloys, and arsenic selenium are examples of intrinsic inorganic pigments. Examples of organic intrinsic pigments are phthalocyanines.

With extrinsic pigments, charges are not readily separated but require charge transporting material or molecules in the vicinity of the photogeneration process for charge separation. Hence by themselves extrinsic pigments are very insensitive to photogeneration. Examples of extrinsic organic pigments are perylene diamine pigments. Extrinsic inorganic pigments include cadmium sulphate and zinc oxide.

U.S. Pat. No. 3,904,407 to Regensburger et. al. discloses multilayer electrophotographic elements including a perylene pigment charge generating layer, a transport layer and a conductive substrate. These perylene pigments can be vacuum-deposited to form high sensitivity charge generation layer. U.S. Pat. Nos. 3,871,882, 4,419,427, 4,578,333, 4,578,334, 4,587,189 and 5,019,473 disclose multilayer imaging members incorporating a perylene-3,4,8,10-tetracarboxylic acid imide derivative pigment charge generation layers wherein the pigment is dispersed in a polymeric binder or vacuum deposited. In all these disclosures, claiming high sensitivity perylene pigment charge generation layers, the charge transport layer consists of solutions or dispersions of arylamine electron donor molecules in a polymer binder.

The sensitivity of a layered device depends on several factors: (1) the fraction of the light absorbed, (2) the efficiency of charge photogeneration within the pigment crystals, (3) the efficiency of injection of photogenerated charge carriers into the transport layer and (4) the distance the injected charge carrier travels in the transport layer in the time between the exposure and development steps. The fraction of the light absorbed can be maximized by increasing the thickness of the generator layer and/or the concentration of pigment in the generator layer. The distance the charge carrier travels in the transport layer can be optimized by the selection of the charge transporting material and by the concentration of the charge transporting active molecular sites. However, the efficiency of photogeneration and injection can be interactive in that both processes depend on both the pigment and the transport material. The photogeneration efficiency with some pigments depends upon the presence of charge transporting material on the surface of and therefore in contact with the pigment. These pigments are extrinsic as distinguished from intrinsic pigments whose photogeneration efficiency is high even in the absence of such transport material.

The layered devices fabricated from extrinsic pigments may be less sensitive in the following situations:

(1) A two layer device in which the charge generator consists of pigment loading in high enough concentration to assure particle contact in an inactive binder and the transport layer is fabricated from a dispersion of charge transporting molecules in an inactive binder. The charge transporting molecules of the transport layer may not be soluble in the binder used for the generator layer. If the generator layer pigment is extrinsic, only that part of the generator layer in contact with the transport molecule is sensitive to light. This would be the pigment located in a very narrow region in the very top part of the generator layer. The exposure or erase light absorbed in the pigment located below this region of the generator layer is essentially wasted. (2) A two layer device whose generator layer is fabricated by sublimation of the extrinsic pigment and whose transport layer is fabricated from a dispersion of charge transporting molecules in an inactive binder which does not penetrate the generator layer. A thin pigment layer located in the very top part of the generator layer is in contact with the charge transporting molecules and the light absorbed in this portion of the generator layer produces free carriers with high efficiency. The exposure or erase light absorbed in the pigment located below this region of the generator layer is essentially wasted. (3) A two layer device containing a generator layer either fabricated from extrinsic pigments in a binder or fabricated from sublimed extrinsic pigments and a transport layer containing a charge transporting polymer that cannot readily diffuse into the generator layer.

There is no certainty that a pigment that seems sensitive in a device employing a charge transport layer containing a solid state solution of charge transport molecules in a polymer binder will have good sensitivity when employed in conjunction with a charge transporting polymer. One of the architectural advantages of multilayered organic photoreceptors is that when fabricated on semitransparent substrates, the erase light can be incident from the substrate side. This option is not easily available for conventional multilayered devices employing extrinsic pigments, as the erase lamp intensity has to be extremely high.

As discussed, the photogeneration efficiency of extrinsic pigments such as benzimidazole perylene by itself is very low (0.01 charge carriers per absorbed photon). A proposed explanation for this is that the absorbed photons produce bound charge pairs (excitons) that recombine or relax to the ground state with very inefficient production of free charge carriers. The presence of electron donor molecules such as those in the charge transport layer enables the excitons at the pigment molecule interface to dissociate by electron transfer from the electron donor molecules, increasing photogeneration efficiency. Thus, the photogeneration efficiency of benzimidazole perylene pigment in the presence of a triphenyl diamine such as N,N'-diphenyl-N,N'-bis (3 methylphenyl)-1,1'-bisphenyl-4,4'diamine, is very high (e.g., 0.3 to 0.6 charge carriers per absorbed photon).

The photogeneration efficiency of a benzimidazole perylene charge generation layer used in conjunction with a charge transport layer composed of a charge transporting polymer such as poly (N-vinylcarbazole), polysilylenes, polyarylamines and others including those described in U.S. Pat. Nos. 4,618,551, 4,806,443, 4,806,444, 4,818,650, 4,935,487, and 4,956,440, is very low when compared to a triphenyldiamine solution charge transport layer used in conjunction with a benzimidazole perylene. This is thought to be because the electron donor moieties in the poly(N-vinylcarbazole) polymer cannot and therefore do not penetrate into the charge generating layer as do the small molecules of triphenyldiamine.

This therefore places a new requirement on the properties of charge transport layer materials. With the use of extrinsic pigments like perylene diamines, a transport polymer material such as poly(N-vinylcarbazole) cannot be employed if it does not meet the aforementioned photogeneration requirements. This produces a particular problem in situations where polymeric charge transport layer materials such as poly(N-vinylcarbazole) are preferred over two phase charge transport layers formed by molecular solutions or dispersions of electron donor molecules in a binder. An example of such a situation are in photoreceptors subject to inks with liquid carriers such as Isopar ® which attack two phase charge transport layers.

SUMMARY OF THE INVENTION

The present invention provides a layered organic photoreceptor comprised of a substrate, an extrinsic pigment charge generating layer disposed on the substrate, a layer of sensitizing electron donor molecules in contact with the charge generating layer, and a charge transport layer comprised of a charge transporting polymer disposed on the pigment layer. A method for producing such a layered photoreceptor according to the present invention and an imaging process using the photoreceptor are also provided.

Layered photoreceptors according to the present invention make it possible to employ polymeric charge transport layers such as poly(N-vinylcarbazole) with extrinsic pigment charge generating layers. The three layer organic photoconducting materials according to the present invention may be especially useful in the case of vacuum deposited generation layers.

DETAILED DESCRIPTION OF THE PREFERRED EMBODIMENT

Figure 1:
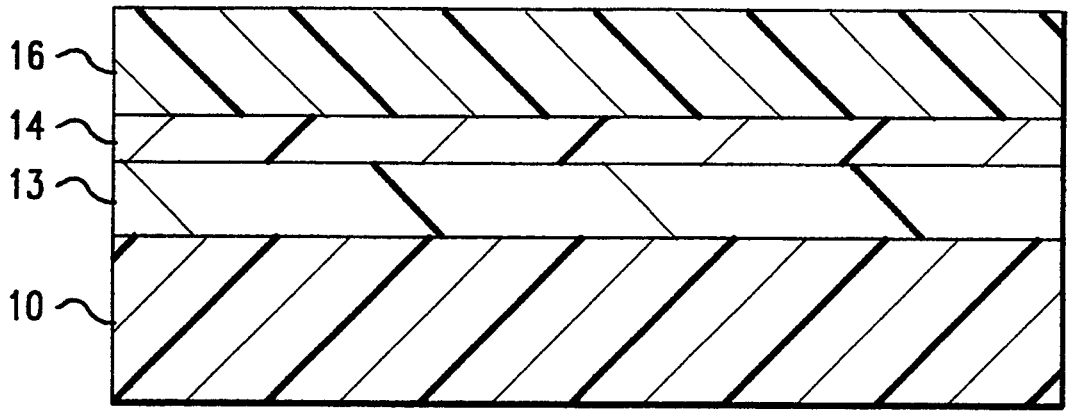
FIG. 1 schematically illustrates a layered photoreceptor in accordance with an embodiment of the present invention with the sensitizing layer underneath the charge generation layer.

Illustrated in FIG. 1 is an example of a layered photoreceptor of the present invention comprising a substrate 10, a layer sensitizing layer 13, an extrinsic pigment charge generating layer 14 in contact with layer 13, and charge transport layer 16 in contact with the pigment charge generating layer 14. Substrate 10 can be opaque or substantially transparent and can be comprised of any of a number of suitable conductive or nonconductive materials possessing, for example, the requisite mechanical properties. Examples of nonconductive substrate materials include various resins known for this purpose including polyesters, polycarbonates, polyamides, polyurethanes, and the like which are flexible as thin webs. The substrate 10 may be flexible or rigid and may have many different configurations, such as for example, a plate, a cylindrical drum, a scroll, an endless flexible belt and the like.

The thickness of substrate 10 depends on many factors including economical considerations, generally, however, this layer for a drum may be of substantial thickness, for example, at a maximum thickness from about 20 millimeters to a of minimum thickness of about 25 micrometers providing there are no adverse effects on the system. Similarly, a flexible belt substrate may be of substantial thickness for example, from a maximum of about 250 micrometers to a minimum thickness of less than 25 micrometers. Substrate layers having thicknesses outside these ranges can be used providing the objectives of the present invention are accomplished.

During manufacture, the surface of the substrate layer is preferably cleaned prior to coating with the sensitizing layer in order to promote greater adhesion of the coating deposited thereon. Cleaning may be effected, for example, by exposing the surface of the substrate layer to plasma discharge, ion bombardment, solvents, etchants and the like.

Figure 4:
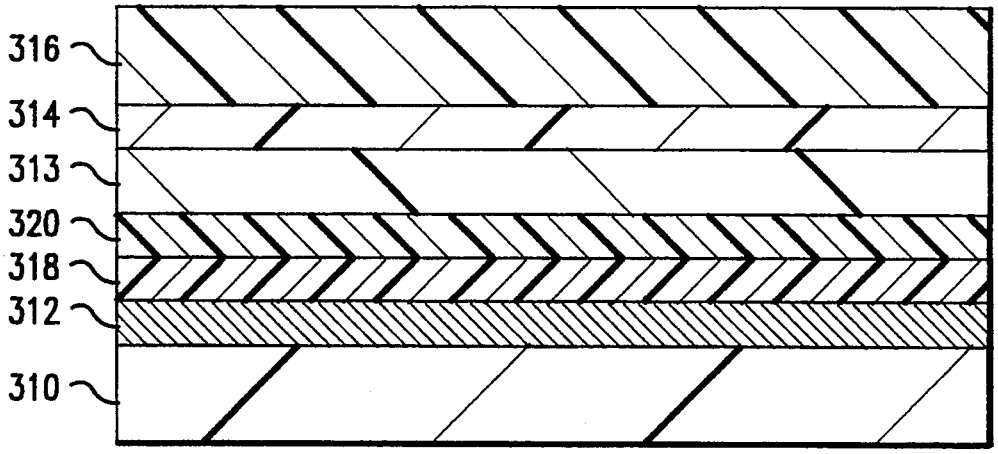
FIG. 4 schematically illustrates the photoreceptor of the present invention wherein a nonconductive substrate is used with a conducting layer.

Referring now to FIG. 4, in photoreceptors wherein the substrate layer 310 is not conductive, a separate electrically conductive layer 312 is required. The conductive layer 312 may vary in thickness over substantially wide ranges depending on the optical transparency, degree of flexibility desired and economic factors. Accordingly, for a flexible photoresponsive imaging device, the thickness of the conductive layer 312 may be between about 2 nanometers to about 75 nanometers, and more preferably from about 10 nanometers to about 20 nanometers for an optimum combination of electrical conductivity, flexibility and light transmission. The conductive layer 312 may be an electrically conductive metal layer formed, for example, on the nonconductive substrate 310 by any suitable coating technique, such as a vacuum depositing technique or electrodeposition.

Typical metals for use in the conductive layer 312 include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Melinex available from ICI with magnetron sputtering.

If desired, an alloy of suitable metals may instead be deposited as electrically conductive layer 312. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members is about $10^2$ to $10^3$ ohms/square.

Figure 2:
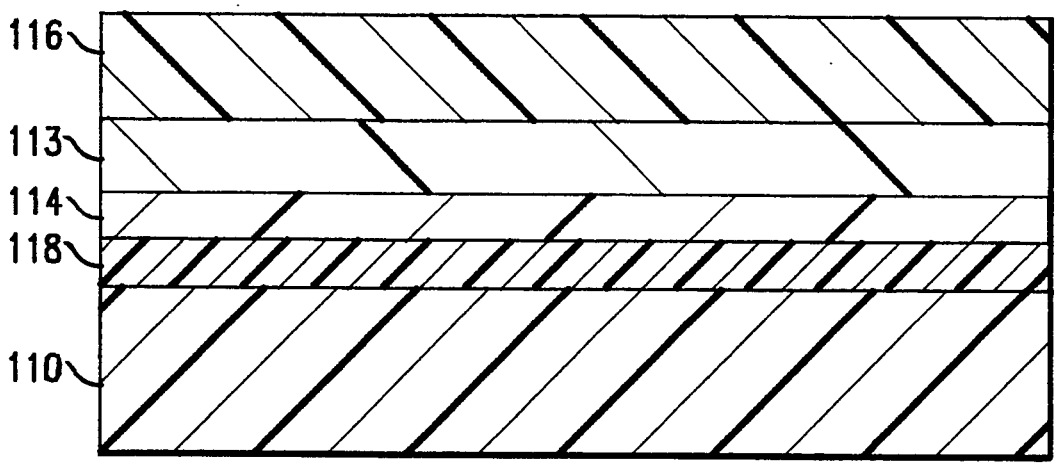
FIG. 2 schematically illustrates a layered photoreceptor with the sensitizing layer between the charge generation layer and the charge transport layer and with an additional barrier layer.
Figure 3:
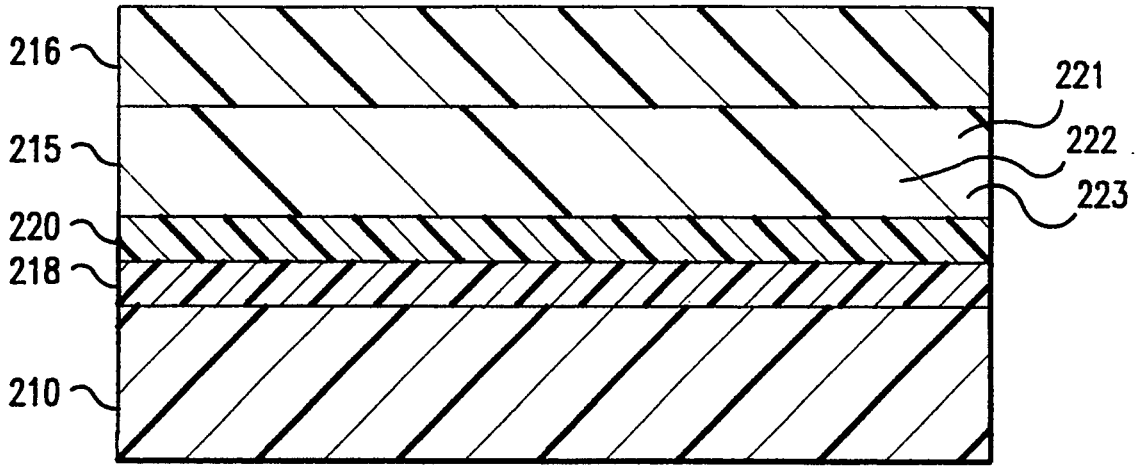
FIG. 3 schematically illustrates the photoreceptor of the present invention wherein the sensitized molecules are incorporated into the charge generating layer. A barrier layer and adhesive layer are also shown.

The layer of sensitizing electron donor molecules, or sensitizer layer, in contact with the charge generating layer can be, as shown in FIG. 1, a separate layer of electron donor molecules in a binder 13 or, as in FIG. 3, may be electron donor molecules 222 incorporated with the polymer binder 223 and the pigment 221 of the charge generator layer 215 itself. The layer of sensitizing electron donor molecules can be introduced underneath the charge generating layer, as shown as layer 13 in FIG. 1, or can be located between the generating and transport layers, as shown as layer 113 in FIG. 2.

The sensitizer layer can be fabricated from a dispersion of electron donor molecules in a polymer binder. The electron donor moiety needs to be donor type if the pigment is required to photogenerate and emit holes. Another option is to introduce the electron donor molecules in the charge generating layer slurry during the fabrication of a dispersion of the pigment and the polymer binder. Typical electron donor molecules for pigment sensitization include, for example, pyrazolines such as 1-phenyl-3-(4'-diethylamino-styryl)-5-(4''-diethylamino-phenyl)-pyrazoline, diamines such as N,N'-diphenyl-N,N'-bis-(3-methylphenyl)-(1,1'-biphenyl)-4,4'-diamine and 1,1'-bis-(4-di-p-tolylaminophenyl)-cyclohexane, hydrazones such as N-phenyl-N-methyl-3-(9-ethyl)-carbazyl-hydrazone and 4,-diethylamino-benzaldehyde-1,2-diphenyl-hydrazone and oxadiazoles such as 2,5-bis-(4-N,N'-diethylaminophenyl)-1,2,4-oxadiazole, triphenyl methanes such as bis-(4,N,N-diethylamino-2-methyl phenyl)-phenyl methane, stilbenes and the like.

The thickness of the layer of sensitizing electron donor molecules in a polymer binder or pigment sensitizing layer is dependent on a number of factors including the thickness of the other layers and economics. Generally, the thickness of the pigment sensitizing layer is from about 0.01 to about 1 micrometers, but thicknesses outside this range can also be used. The pigment sensitizing layer should be an insulator to the extent that the electrostatic charge placed on the sensitizing layer is not conductive in the absence of illumination at a rate sufficient to prevent formation and retention of an electrostatic latent image thereon. In other words, the pigment sensitizing layer, is substantially non-absorbing to visible light or radiation in the region of intended use but is "active" in that it assists the photogeneration of holes when visible or infra red radiation is absorbed in the pigment in the charge generation layer. In general, the ratio of the thickness of the pigment sensitizing layer to the charge generator layers is preferably maintained from about 1:2 to 1:20.

Referring back to FIG. 1, the photogenerating pigment layer 14 is comprised of photoconductive particles or pigments randomly dispersed in a resinous binder matrix. Accordingly, the photogenerating layer can comprise various photoconductive charge carrier photogenerating materials known for use in xerography, providing such materials are electronically compatible with the charge carrier transport layer 16, that is, for example, the material selected will allow the injection of photoexcited charge carriers into the transport layer 16, and allow charge carriers to travel across the interface between the photogenerating layer 14 and the charge carrier transport layer 16. Generally, the thickness of the pigment layer is from about 0.05 to about 5 micrometers. A thickness of 0.2 to 2 micrometers is preferred.

Any suitable polymeric film forming binder material may be employed as the matrix in the photogenerating layer. Typical polymeric film forming materials include those described, for example, in U.S. Pat. No. 3,121,006, the entire disclosure of which is incorporated herein by reference. Thus, typical polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyl resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 60 percent by volume of the photogenerating pigment is dispersed in about 40 percent by volume to about 80 percent by volume of the resinous binder composition. The photogenerating layers can also be fabricated by vacuum sublimation in which case there is no binder. Preferred photogenerating pigments for use in the present invention include microcrystalline perylene diamines with benzimidazole perylene being preferred.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer has to be fabricated in a dot or line pattern. Removing of the solvent of a solvent coated layer may be effected by any suitable conventional technique such as oven drying, infra red radiation drying, air drying and the like.

Referring back to FIG. 1, the charge transport layer 16 comprises charge transporting small molecules dissolved or molecularly dispersed in a film forming inert polymer such as polycarbonate. Alternatively, and preferably the charge transport layer is fabricated from a charge transporting polymer comprising charge transporting moieties that are incorporated in the film forming polymer. For purposes of this invention charge transporting layer is intended to mean both. When the transport layer is fabricated employing a charge transporting polymer, the charge transporting moiety is incorporated in the polymer as a pendant or in the chain or may form the backbone of the polymer. This type of charge transport polymer includes materials such as polyvinylarylamines, consisting of a vinyl backbone with arylamine pendant groups of which poly-N-vinylcarbazole or is the best known example, polysilylenes, polyarylamines where the arylamine is incorporated in the chain and others including those described in U.S. Pat. Nos. 4,618,551, 4,806,443, 4,806,444, 4,818,650, 4,935,487, and 4,956,440.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge or hole transport layer is between about 10 to about 50 micrometers, but thicknesses outside this range can also be used. The hole transport layer, like the sensitizing layer, should be an insulator to the extent that the electrostatic charge placed on it is not conducted in the absence of illumination at a rate sufficient to prevent formation and retention of an electrostatic latent image thereon. In other words, the charge transport layer, is substantially nonabsorbing to visible light or radiation in the region of intended use but allows the injection of photogenerated holes from the photoconductive layer, i.e., charge generation layer, and allows these holes to be transported through itself to selectively discharge a surface charge on the surface of the charge transport layer.

The electron donor molecule (charge transport) material can be incorporated into the resinous binder composition in various amounts providing the objectives of the present invention are achieved, however, generally from about 10% by weight to about 80% percent by weight of the charge transport material and preferably from about 30% percent by weight to about 60% percent by weight of the charge transport are incorporated into resinous binder composition. In general, the ratio of the thickness of the hole transport layer to the charge generator layer is preferably maintained from about 2:1 to 200:1 and in some instances as great as 400:1.

FIG. 3 illustrates a photoreceptor according to the present invention wherein there is included in the photoreceptor device an optional adhesive layer 220, this layer ranges in thickness of from about 50 nanometers to about 1 micrometer, although thicknesses outside these ranges can be selected providing the objectives of the present invention are achieved. Preferred material from which the adhesive layer can be made include film forming polymers including polyester adhesives, epoxies, polycarbonates, polyvinylchlorides, polyurethanes, polyarylates, vinylidene chloride containing polymers, copolymers of the above including acrylonitrile copolymer and the like disclosed for example in U.S. Pat. Nos. 4,082,551, 4,173,473 and 4,578,333. The adhesive layer may include a hydrolyzed siloxane which promotes adhesion between a polymer and a metal (oxide) surface. This layer in addition to providing adhesion between the substrate and the other layers may also act as a charge blocking layer. A further example of an adhesive layer 320 is shown in FIG. 4 between barrier layer 318 and sensitizing layer 313. Barrier layer 318 is used in the device to block charge injection from the conductive layer. Typical blocking layers include polyvinylbutyral, organosilanes, epoxy resins, polyesters, polyamides, polyurethanes. polyvinylchlorides, polyacrylates, copolymers of the above including acrylonitrile copolymer and the like disclosed in U.S. Pat. Nos. 4,286,033, 4,291,110, 4,338,387 and 4,588,667. Other blocking layer materials include oxides and nitrides of metals.

The photoreceptor of the present invention can be prepared by various known methods and can be incorporated in xerographic imaging systems well known in the art. An electrostatic latent image is formed on the device, followed by development of the image with developer particles containing toner and carrier particles, followed by subsequently transferring the image to a permanent substrate, and optionally affixing the image thereto by heat. The image may be developed by any well known xerographic development techniques including, for example, cascade, magnetic brush development, and the like. The visible image is typically transferred to receive a member by any conventional transfer technique and affixed thereto. While it is preferable to develop the electrostatic latent image with marking material the image may be used in a number of other ways such as, for example, reading the latent image with an electrostatic scanning system.

Other optional layers may also be used such as conventional electrically conductive ground strip along one edge of the belt or drum in contact with the conductive layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

The invention will now be described with respect to specific examples, it being understood that these examples are intended to be illustrative only and the invention is not intended to be limited to the materials, conditions, process parameters, recited herein. All parts and percentages are by weight unless otherwise indicated.

EXAMPLES

Example 1

An electrophotographic imaging member is prepared by forming coatings using conventional coating techniques on a substrate comprising a vacuum deposited titanium layer on a polyethylene terephthalate film (Melinex ®, ICI). The first coating is a siloxane barrier layer formed from hydrolyzed gamma aminopropyltriethoxysilane having a thickness of 0.005 micrometer (50 Angstroms). This film is coated as follows: 3-aminopropyltriethoxysilane (PCR Research Chemicals of Florida) is mixed in ethanol in a 1:50 volume ratio. The film is applied to a wet thickness of 12 micrometers by a multiple clearance film applicator. The layer is then allowed to dry for 5 minutes at room temperature, followed by curing for 10 minutes at 110 degree centigrade in a forced air oven. The second coating is an adhesive layer of polyester resin (49,000, E. I. dupont de Nemours & Co.) having a thickness of 5 nanometers and is coated as follows: 0.5 grams of 49,000 polyester resin is dissolved in 70 grams of tetrahydrofuran and 29.5 grams of cyclohexanone. The film is coated by a 12 micrometer bar and cured in a forced air oven for 10 minutes. The next coating is a charge generator layer of sublimed bis-benzimidazole perylene, formed by the reaction of perylene-3,4,9,10-tetracarboxylic acid anhydride and ortho-phenylene diamine, described in U.S. Pat. No. 4,587,189. The sublimation is carried out in a vacuum of approximately $10^5$ Torr employing stainless steel boats heated to 550° C. A 0.2 micrometer thick film is deposited in 6 to 7 minutes. The top coating is a 20 micrometer thick transport layer of polyether carbonate. It is coated with a solution containing one gram of charge transport polyether carbonate resin dissolved in 11.5 grams of methylene chloride solvent using a Bird coating applicator. The polyether carbonate resin is prepared as described in Example III of U.S. Pat. No. 4,806,443. This polyether carbonate resin is an electrically active charge transporting film forming binder and can be represented by the formula:

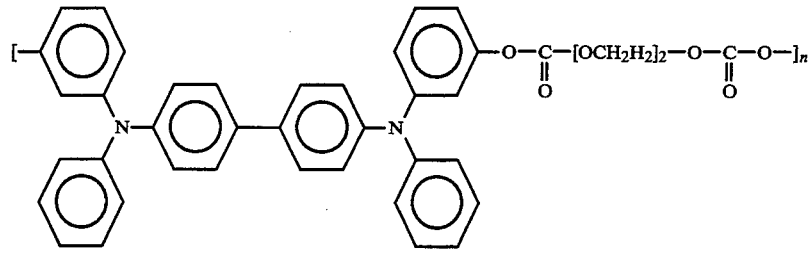

wherein n is about 300 in the above formula so that the molecular weight of the polymer is about 200,000. The film is dried in a forced air oven at 100° C. for 20 minutes. The device is mounted on a cylindrical aluminum drum which is rotated on a shaft. The film is charged by a corotron mounted along the circumference of the drum. The surface potential is measured as a function of time by several capacitively coupled probes placed at different locations around the shaft. The probes are calibrated by applying known potentials to the drum substrate. The film on the drum is exposed and erased by light sources located at appropriate positions around the drum. The measurement consists of charging the photoconductor device in a constant current or voltage mode. As the drum rotated, the initial charging potential is measured by probe 1. Further rotation leads to the exposure station, where the photoconductor device is exposed to monochromatic radiation of known intensity. The surface potential after exposure is measured by probes 2 or 3. The device is finally exposed to an erase lamp of appropriate intensity and any residual potential is measured by probe 4. The process is repeated with the magnitude of the exposure automatically changing during the next cycle. A photo induced discharge characteristic curve is obtained by plotting the potentials at probes 2 and 3 as a function of exposure. One measure of sensitivity is the initial slope of the discharge curve and is generally expressed by the symbol S and has units of Volts $cm^2$ $ergs^{-1}$. The sensitivity of this device is compared to that of a similar device but containing a sensitizer layer and described in Example 2.

Example 2

A device very similar to that described in Example 1 is fabricated, the only difference being the introduction of a sensitizer layer between the adhesive polyester layer and the charge generator layer of benzimidazole perylene. A 1 micrometer thick pigment sensitizer layer is coated with a solution containing one gram of N,N'-diphenyl-N,N'-bis(3-methyl-phenyl)-(1,1'biphenyl)-4,4'-diamine and one gram of polycarbonate resin, a poly(4,4'-isopropylidene-diphenylene carbonate), available under the trademark Makrolon ® from Farbenfabricken Bayer A. G., dissolved in 11.5 grams of methylene chloride solvent using a Bird coating applicator. The N,N'-diphenyl-N,N'-bis-(3-methyl-phenyl)-(1,1'-biphenyl)-4,4'-diamine is an electron donor small molecule whereas the polycarbonate resin is an electrically inactive film forming binder. N,N'- diphenyl-N,N'-bis(3-methyl-phenyl)-(1,1'-biphenyl)-4,4'-diamine has the formula:

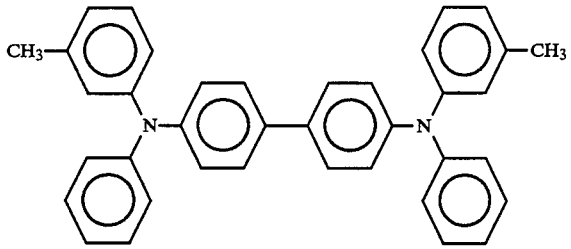

The film is dried in a forced air oven at 100° C. for 20 minutes. The sensitivity of this device is tested in a scanner described in Example 1 and compared to that of the device described in Example 1. A substantial increase in the initial slope S is observed as a result of introduction of the sensitizer layer.

Example 3

A device very similar to that described in Example 1 is fabricated, the only difference being the replacement of the polyether carbonate transport layer by a transport layer of poly methyl phenyl silylene. The transport layer consisted of poly (methyl phenyl) silylene represented by the structure:

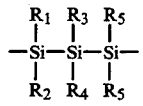

wherein $R_1$, $R_3$ and $R_5$, are methyl groups and $R_2$, $R_4$ and $R_6$ are phenyl groups. The transport layer is coated from a solution of two percent by weight of poly (methyl phenyl) silylene in toluene. The device is heated in a vacuum oven maintained at 80° C. to form a dried coating having a thickness of 20 micrometers. The device is tested for its sensitivity by the technique described in Example 1 and is compared to that of the device with the sensitizer layer described in Example 4.

Example 4

A device very similar to that described in Example 3 is fabricated, the only difference being the introduction of a sensitizer layer between the adhesive polyester layer and the charge generator layer of benzimidazole perylene. A one micrometer thick pigment sensitizer layer is coated with a solution containing one gram of N,N'-diphenyl-N,N'-bis(3-methyl-phenyl)-(1,1'biphenyl)-4,4'-diamine and one gram of polycarbonate resin, a poly(4,4'-isopropylidene-diphenylene carbonate). The details of fabrication of this layer and the structure of N,N'-diphenyl- N,N'-bis(3-methyl-phenyl)-(1,1'biphenyl)-4,4'-diamine are described in Example 2. The sensitivity of this device is tested in a scanner described in Example 1 and compared to that of device described in Example 3. A substantial increase in the initial slope S is observed as a result of introduction of the sensitizer layer.

Example 5

A device very similar to that described in Example 1 is fabricated, the only difference being the replacement of the poly ether carbonate transport layer by a transport layer of N,N'-diphenyl-N,N'-bis(3-methyl-phenyl)-(1,1'biphenyl)-4,4'-diamine dispersed in polycarbonate. A 20 micrometer thick transport layer is coated with a solution containing one gram of N,N'-diphenyl-N,N'-bis(3-methyl-phenyl)-(1,1'biphenyl)-4,4'diamine and one gram of polycarbonate resin, a poly(4,4'-isopropylidene-diphenylene carbonate), available under the trademark Makrolon ® from Farbenfabricken Bayer A. G., dissolved in 11.5 grams of methylene chloride solvent using a Bird coating applicator. The structure of N,N'-diphenyl-N,N'-bis(3-methyl-phenyl)-(1,1'biphenyl)-4,4'-diamine is described in Example 2. The film is dried in a forced air oven at 100° C. for 20 minutes. The device is tested for its sensitivity by the technique described in Example 1 and compared to that of the device with the sensitizer layer described in Example 6.

Example 6

A device very similar to that described in Example 5 is fabricated, the only difference being the introduction of a sensitizer layer between the adhesive polyester layer and the charge generator layer of benzimidazole perylene. A 1 micrometer thick pigment sensitizer layer is coated with a solution containing one gram of N,N'-diphenyl-N,N'-bis(3-methyl-phenyl)-(1,1'biphenyl)-4,4'-diamine and one gram of polycarbonate resin, a poly(4,4'-isopropylidene-diphenylene carbonate). The details of fabrication of this layer and the structure of N,N'-diphenyl-N,N'-bis(3-methyl-phenyl)-(1,1'biphenyl)-4,4'-diamine are described in Example 2. The sensitivity of this device is tested in a scanner described in Example 1 and compared to that of device described in Example 5. A substantial increase in the initial slope S is observed as a result of introduction of the sensitizer layer.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A layered photoreceptor comprised of:

a substrate;

an extrinsic pigment layer that has been sensitized by being in contact with electron donor molecules disposed over the substrate; and a charge transport layer comprised of a charge transporting polymer layer disposed over the pigment layer.

2. The photoreceptor according to claim 1, wherein said electron donor molecules are in a binder in the form of a layer between said substrate and said pigment layer.

3. The photoreceptor according to claim 1, wherein said electron donor molecules are dispersed within the extrinsic pigment layer.

4. The photoreceptor according to claim 1, wherein said electron donor molecules are in a binder in the form of a layer between said charge transport and said pigment layer.

5. The photoreceptor according to claim 1, wherein the sensitizing electron donor molecules are aryl amine molecules.

6. The photoreceptor according to claim 5 wherein the aryl amine molecules are selected from the group consisting of pyrazolines, monoamines, diamines, polyamines, hydrazones, oxadiazoles, triphenyl methanes and stilbenes.

7. The photoreceptor according to claim 1, wherein said pigment is selected from the group consisting of microcrystalline perylenes, and perinones.

8. The photoreceptor according to claim 7, wherein said pigment is benzimidazole perylene.

9. The photoreceptor according to claim 1, wherein the charge transporting polymer is comprised of a polyvinylarylamine.

10. The photoreceptor according to claim 1, wherein the charge transporting polymer is comprised of a of polysilylene.

11. The photoreceptor according to claim 1, wherein the charge transport layer is comprised of a polyarylamine.

12. The photoreceptor according to claim 1, wherein said charge transport layer is comprised of at least one member of the group consisting of pyrazolines, diamines, hydrazones, oxadiazoles, triphenyl methanes and inactive stilbenes in a polymer binder.

13. The photoreceptor according to claim 1, wherein the layer of sensitizing electron donor molecules is from about 0.01 to about 1 micrometers thick.

14. The photoreceptor according to claim 13, wherein the layer of sensitizing electron donor materials is 0.1 micrometers thick.

15. The photoreceptor according to claim 1, wherein said pigment layer is from about 0.05 to about 5 micrometers thick.

16. The photoreceptor according to claim 15, wherein the pigment layer is about 0.5 micrometers thick.

17. The photoreceptor according to claim 1, which further comprises an adhesive layer between the substrate and the electron donor molecules.

18. A photoreceptor comprised of a conducting substrate; a charge generator layer of extrinsic pigment disposed over said substrate; a sensitizing layer comprised of electron donor molecules in contact with said charge generator layer; and a charge transport layer disposed on said sensitizing layer.

19. A method for producing a photoreceptor comprising: depositing a layer of sensitizing electron donor material in a polymer binder on a substrate;

depositing an extrinsic pigment layer on the layer of sensitizing electron donor material; and depositing a charge transport layer comprising a charge transporting polymer on said pigment layer.

20. An imaging process comprising;

providing an electrophotographic imaging member comprised of a sensitizer layer, a charge generating layer and a charge transport layer, said charge sensitizer layer comprising electron donor molecules in an binder;

depositing a uniform electrostatic charge on said imaging member with a corona charging device;

exposing said imaging member to activating radiation in image configuration to form an electrostatic latent image on said imaging member;

developing said electrostatic latent image with electrostatically attractable marking particles to form a toner image;

transferring said toner image to a receiving member; and repeating said depositing, exposing, developing and transferring steps.

* * * * *